US005913798A

United States Patent [19]

Grabber

[11] Patent Number: 5,913,798

[45] Date of Patent: Jun. 22, 1999

[54] CAN AND CLOSURE DIAPHRAGM, AS WELL AS PROCESS AND APPARATUS FOR TIGHTLY CONNECTING A CAN WALL WITH THE CLOSURE DIAPHRAGM

[76] Inventor: Werner Grabher, Oberwingerstrasse 8, CH-9436 Balgach, Switzerland

[21] Appl. No.: 08/936,535

[22] Filed: Sep. 24, 1997

Related U.S. Application Data

[63] Continuation-in-part of application No. PCT/EP96/01410, Mar. 30, 1996, and application No. PCT/EP97/03144, Jun. 17, 1997.

[30] Foreign Application Priority Data

Apr. 2, 1995 [EP] European Pat. Off. ..... 95104906
Jul. 21, 1996 [EP] European Pat. Off. ..... 96111741

[51] Int. Cl.[6] ..... B65B 7/28; B65D 51/20

[52] U.S. Cl. ..... 53/478; 53/329.2; 53/353; 53/489; 413/5; 413/26

[58] Field of Search ..... 413/26, 5, 4; 53/478, 53/489, 326, 329.2, 330, 344, 353, 488

[56] References Cited

U.S. PATENT DOCUMENTS

| | | | |
|---|---|---|---|
| 1,272,789 | 7/1918 | Ford | 413/5 X |
| 1,595,304 | 8/1926 | Hulbert | 413/5 X |
| 1,867,288 | 7/1932 | Thomas . | |
| 3,299,845 | 1/1967 | Geiger et al. | 413/26 |
| 4,599,123 | 7/1986 | Christensson | 156/69 |
| 5,566,529 | 10/1996 | Sireix | 53/489 X |
| 5,577,370 | 11/1996 | Pajak et al. | 53/478 |

FOREIGN PATENT DOCUMENTS

| | | |
|---|---|---|
| 0007487 | 2/1980 | European Pat. Off. . |
| 0540748 | 5/1993 | European Pat. Off. . |
| 9414440 | 1/1995 | Germany . |
| 60-24238 | 2/1985 | Japan . |
| 642316 | 4/1984 | Switzerland . |
| 659633 | 2/1987 | Switzerland . |
| 8404507 | 11/1984 | WIPO . |

*Primary Examiner*—James F. Coan
*Attorney, Agent, or Firm*—Rothwell, Figg, Ernst & Kurz

[57] ABSTRACT

In can production, a press apparatus is provided for tightly connecting a first contact surface of the can wall running around an axis to a second contact surface of a base, a lid or a closure membrane. If the press parts (16) are arranged essentially fixed in the axial direction or are held in a radial guide and can be moved radially by an actuating element (8) displaceable in the axial direction, the can need not also be moved during pressing. The contact regions of the can wall and of the separation element are guided in the region with the press surfaces. The end face of the can rests against a stop which is connected to the radial guide for the press parts and is immobile at least during the pressing process. Owing to the conical abutting region (18) between the actuating element (8) and the press parts (16), these can be pressed outward by means of an axial movement of the actuating element (8). For restoring and/or for achieving a gap-free press surface, three open rings (17) having gaps staggered relative to one another are arranged around the press parts (16).

28 Claims, 6 Drawing Sheets

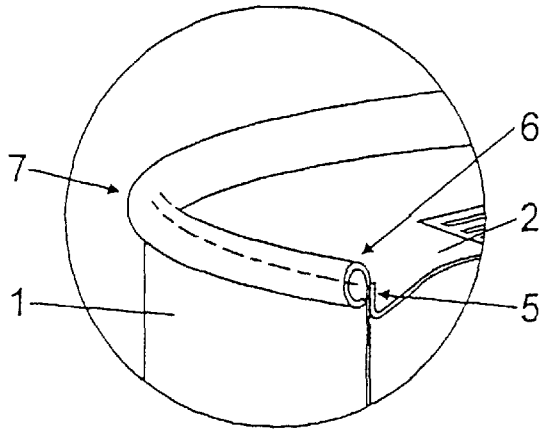
Fig.1
Fig.2
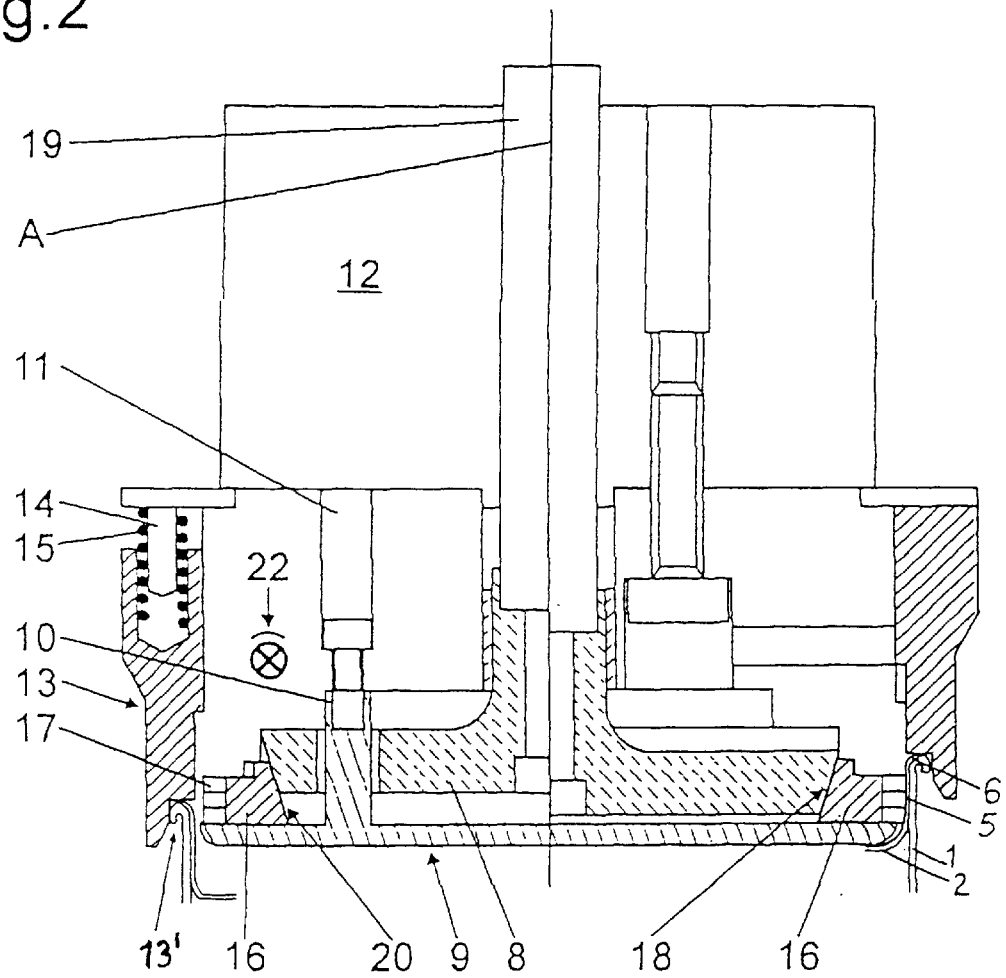

CAN AND CLOSURE DIAPHRAGM, AS WELL AS PROCESS AND APPARATUS FOR TIGHTLY CONNECTING A CAN WALL WITH THE CLOSURE DIAPHRAGM

CROSS-REFERENCE TO RELATED APPLICATIONS

This application is a continuation-in-part application of PCT/EP96/01410, filed Mar. 30, 1996, and PCT/EP97/03144, filed Jun. 17, 1997.

BACKGROUND OF THE INVENTION

DESCRIPTION OF THE BACKGROUND ART

In the production of various cans which comprise a can wall running around the can axis and at least one separation element running at least partly transversely to the can axis, a first contact surface of the can wall is tightly connected by a pressing process to a second contact surface of the separation element, which surface can be laid against the first surface. The separation element is formed, for example, as a base, lid or closure membrane.

In the case of cans, it is known that the base and/or lid or at least parts of the first and/or second contact surfaces can be provided with a sealing material in order to be able to achieve a tight connection by pressing together the contact surfaces and supplying heat. In order to achieve a good compression effect, the press apparatuses used are, for example, those in which the—particularly annular—contact surfaces are introduced between inner and outer conical ring parts while the ring parts are then moved toward one another by an axial movement. Furthermore, the conical press surfaces also result in the formation of a conical connection, which is undesirable in many cans.

It is true that Swiss Patent 659,633 discloses a can whose end face is closed by means of a raised diaphragm. However, a feature essential to that invention is a heat-conducting lid which remains in the can until the latter is opened by the end user (FIG. 9), whereupon the diaphragm too is removed and the can no longer complies with the claim. An intermediate product according to Swiss Patent 659,633 which is suitable for filling at the open opposite end prior to final sealing, has a heat-conducting lid which makes the can expensive and complicated.

With the can disclosed in FIG. 9 of Swiss Patent 659,633, the internal diameter of the heat-conducting lid must in fact exactly correspond to the internal diameter of the can minus twice the diaphragm wall thickness, with the result that wrinkles and creases can be established in the foil edge region during deep drawing.

In a further solution according to the prior art, for example, a cylindrical pipe section having a circular cross-section is separated along square sides with sectional planes parallel to the axis, the corners of the square being inside or outside the wall of the pipe section and the sectional planes each leading in a middle region through the interior of the pipe section. This gives rise to four outer and four inner, essentially triangular press parts, each with a part of the cylindrical press surface. For pressing, the outer press parts and carried by these, also the inner press parts are brought together. Because the sliding surfaces between the outer and the inner press parts are transverse to the contact surfaces to be pressed, the acute-angled ends of the press surfaces of the inner press parts may lead to injuries or creases in the pressed contact surface. In order to keep these defects as small as possible, pressing must be carried out as far as possible exactly with the radius of the pipe section, which is frequently not possible owing to tolerances of the can parts.

EP 007 487 discloses a press apparatus having a table which is vertically displaceable on a support element and having a pressure means with two segments whose outward-pointing edges can be used as press surfaces. Resting on one conical surface of the support element are beveled contact surfaces of two transverse webs, which transverse webs are each connected to a segment and are displaceably mounted on the table perpendicularly to the axis of the support element. In order to press a cylindrical contact region of the can membrane, running around a can axis, against the inner wall regions of a can by means of the press surfaces of the two segments, the table together with the can must be pressed or moved downward. A substantial disadvantage of this solution is that the table with the can must be pressed downward. Even if the compression force is not transmitted by the can to the table, the can must be pressed against the table from the top during the movement of the table, which entails a complicated construction for holding cans of different sizes or, in the case of inadequately held cans, gives rise to problems with the exact insertion of the separation element. A further disadvantage is that the movement toward the contact region, required for pressing, takes place only in the direction of the transverse webs or in the central regions of the segments. Accordingly, the contact region will be slightly deformed to an oval shape during pressing and the compression is weaker in the flattened regions.

SUMMARY OF THE INVENTION

In accordance with one aspect of the present invention, an intermediate can structure is provided having a sheet metal sidewall that is open at one end and fillable at the open end prior to sealing and closing of the can structure. The intermediate can structure has a closed end opposite said open end, the closed end being sealed by a closure diaphragm of a material selected from the group consisting of paper, plastic film and metal foil. The intermediate can structure has an axis, and the closure diaphragm has a diaphragm edge region which is raised in a direction of said axis. The diaphragm edge region is tightly connected to an inner surface of said sidewall without overlapping an edge of said sidewall that is tightly connected to said diaphragm edge region, and the diaphragm edge region is free from a heat-conducting cover.

A can according to the invention can be produced, for example, by the process according to the invention or with the aid of the apparatus according to the invention. For example, a foil having a slightly conically shaped foil edge region can be used here and said foil edge region is tightly heat-sealed to the inner wall of the can in a relatively broad gap between punch and inner wall of the can by expansion of the punch circumference.

In order also to achieve essentially cylindrical connection regions or contact surfaces connected to one another, at least one press surface must be radially adjustable so that it can be pressed against the contact surfaces after the introduction of the latter. For example, chucks having axial lamellae which project approximately conically outward or inward in the open state to receive the cylindrical contact surfaces are used for this purpose. For pressing, the lamellae are slightly pressed together or pressed on by a special clamping part. In the regions of the gap between the lamellae, no pressing takes place, so that channels may remain open through the contact region. The channels are undesired, axially oriented passages between the contact surfaces.

It is an object of the invention to provide a can and closure diaphragm, as well as process and apparatus for tightly connecting a can wall with the closure diaphragm avoiding the above draw-backs, and to provide, more specifically a simple and reliably operating press apparatus which is suitable for the annular, tight connection of a can wall to a separation element. The press apparatus should be capable of being used for cans of various heights and made of all known can materials. This object is achieved by one or more features of the invention described in detail in the following.

If the press parts are arranged essentially fixed in the axial direction or are held in a radial guide and can be moved radially by means of an actuating element displaceable in the axial direction, the can need not also be moved during pressing. The contact regions of the can wall and of the separation element are guided in the region with the press surfaces. The end face of the can is against a stop which is connected to the radial guide for the press parts and is immobile at least during the pressing process.

During pressing from the inside, press parts having a convex press surface must be capable of being moved from a feed position with a smaller press surface circumference to a pressing position with a larger circumference. The size of usable segments and/or elastic rings is adapted to the smaller circumference in the feed position, in which the can parts can be fed to the press apparatus. In order to ensure essentially a movement of the press surfaces radially outward along the entire circumference, more than two press parts must be provided. The larger the number of parts with smaller circumferential regions, the more easily will it be possible to achieve an increase in the circumferential line with uniform shape. Preferably, six press parts are provided because this number permits good approximation to all conventional can cross-sections at an acceptable cost.

During pressing from the outside, press parts—more than two, preferably six—having a concave press surface must be capable of being moved from a feed position with a larger press surface circumference to a pressing position with a smaller circumference. The parts which can be moved from the outside to the pressing position may be dimensioned so that they form a step-free, closed circumferential line when they rest against one another.

In preferred embodiments, during pressing from the outside, jamming of the pressed can material in the gaps should also preferably be prevented during abutment, in particular in the final phase in which the gaps between the press surfaces disappear.

During pressing from the inside, the press surface of the press parts of possible embodiments do not extend along the total larger circumference, so that at least one gap is adjacent to the contact surface to be pressed. A leaking connection, in particular channels, may form in the region of the gaps.

In order to prevent channels or damage, a preferred embodiment envisages arranging elastic piston rings having staggered orifices between the press parts and the can wall. This prevents the formation of channels or damage which extend or extends in the axial direction over the entire connection region between can wall and separation element.

The press apparatus comprises a press surface which is composed of at least two part-surfaces or at least two press parts. The part-surfaces each extend along a part of a circumferential line in a plane which is essentially perpendicular to the main or can axis. In order to achieve uninterrupted pressing along the entire circumference and to do so even the press parts deviate slightly from the optimal mutual arrangement in the pressing position owing to can tolerances, the part-surfaces adjacent to one another in the axial direction are arranged so that at least one part-surface is always provided along the entire circumference. The gaps forming in the circumferential direction between part-surfaces of a circumferential line are displaced in the circumferential direction relative to the gaps of another circumferential line. The part-surfaces are arranged in layers in the axial direction, at least two, preferably three, layers being provided. The adjacent part-surfaces of different layers are optionally formed by parts adjacent to one another in the axial direction. Preferably, however, they are formed by press surfaces of the press parts, which surfaces have stepped edges on both sides in the circumferential direction, the steps of the press parts adjacent to one another in the circumferential direction fitting into one another.

The press parts are preferably in the form of segments or annular segments and are mounted so that they are essentially radially movable relative to the main axis with their central region. During the radial movement between the feed and the pressing position, the degree of overlap of the press parts varies by virtue of the fact that the steps or layers of the press parts, which fit into one another, engage one another to a greater or lesser extent. In the case of convex press surfaces provided for pressing from the inside, the overlap is maximum in the feed position and minimum in the pressing position. Accordingly, in the case of concave press surfaces provided for pressing from the outside, the overlap is maximum in the feed position and minimum in the pressing position. The guaranteed overlap ensures that no passages free of press surface form during pressing from the inside and no damage or jamming of can material transversely through the entire contact region is possible during pressing from the outside.

In order to achieve good interaction of the part-surfaces, the outer radius of the convex press parts is optionally slightly smaller than—in particular essentially the same size as—the radius of the contact surface to be pressed. Accordingly, the press surface formed from the part-surfaces may deviate slightly inward from the circular shape in the overlap region but is essentially circular in particular in the pressing position. In connection regions which do not have circular cross-sections, essentially the respective cross-section is achieved in the pressing position. Analogously, in the case of press parts having concave press surface, the inner radius of the press part is equal to or slightly larger than the radius of the contact surface to be pressed.

The longitudinal contour of the press surfaces in a plane through the main axis can be adapted to the respective desired longitudinal contour between the contact surfaces to be connected to one another.

A radial movement of the press parts has the advantage that the change from the feed position into the pressing position is permitted by an extremely small movement of the press parts, essentially no frictional movement taking place between the contact surface and the press parts in the circumferential direction. Owing to the small movement and the low friction, only a small force is required for actuating and in particular for restoring the press parts. In the preferred embodiments, the movement into the pressing position takes place by means of the movement of an actuating element. During pressing from the inside, the actuating element is preferably a conical part which is displaceable in the axial direction and whose outer or actuating surface is in contact with conical abutting surfaces of the press parts. During pressing from the outside, a cone inner surface section against which conical outer surfaces of the press part rest as abutment surfaces is preferably used as the actuating surface. In order to achieve the desired movement, the press parts are guided in particular in a linear guide oriented essentially perpendicular to the main axis, and the actuating element can be moved essentially along the main axis. During the movement of the actuating element in a first actuating direction, the press parts are pressed against the can contact surfaces; in a second direction of movement, the press parts can preferably be restored by spring elements and pressed against the actuating element.

As a result of the relative movement between the actuating element and the press parts, those contour lines of the actuating surface and of the abutment surfaces which are opposite one another in planes normal to the main axis also move. To prevent jamming effects between the adjacent parts, the radii of the contour lines are chosen so that the radius of the outer line is always greater than or equal to the radius of the inner line in the total region between the feed and the pressing position. To ensure optimal force transmission during pressing, essentially the same radii are coordinated with one another preferably in the region of the pressing position, and accordingly the surfaces rest essentially tightly against one another. In the region of the feed position, the surfaces rest against one another essentially only along a straight generator.

When press-on clamping rings are used, the frictional movement is substantially greater, and there is also a danger of noncircular pressing. Moreover, when open rings are used, the single gap is essentially as large as the total of all gaps between a plurality of press parts which may be provided.

The connection between the contact surfaces pressed against one another is frequently achieved by heating at least one sealing coat applied to a contact surface. Heat is preferably supplied via the press surface. For this purpose, good heat transmission must be achievable from the press apparatus to the contact surfaces or the press surfaces. It has now been found that this cannot be ensured in a simple manner with the use of elastic rings. An optimal heat flow is achieved with press parts in the form of ring parts. At least one heating element is in heat-conducting contact, preferably via a heat-conducting member, with a transmission surface of the press part, which surface is in particular normal to the main axis and has sufficiently large dimensions for the desired heat flow. In the press part, the heat flows directly to the part-surface without a further transitional contact. If required, a heating element could be connected to each press part. However, a heating apparatus which has a heating surface adjacent to the transmission surfaces of all press parts is preferably provided, the transmission surfaces sliding along the heating surface during the movement of the press parts. In order to adapt each press surface to the various can cross-sections, all that is necessary is to change the press parts, the heating apparatus remaining on the press apparatus.

Press apparatuses according to the invention can be used in a very wide range of arrangements. Owing to the optimally shaped and continuous press surface, pressing can generally be carried out without an abutting surface, at least in the case of seals. For separation elements or can closures having contact surfaces which are adjacent to the can wall on the inside or outside, pressing by means of a convex or concave press surface, respectively, from the inside or outside, respectively, is sufficient. The stability of the can wall is very high during pressing by means of a press surface of the same shape. The possibility of pressing without an abutting surface is a further advantage of the press apparatus according to the invention and permits, for example, the mounting of a can closure after the mounting of the other can closure or of a separation membrane.

Further details of the invention are evident from the following description of examples illustrated in the drawings.

BRIEF DESCRIPTION OF THE DRAWINGS

FIG. 1 shows a part of a can with an inserted membrane,

FIG. 2 shows a section through the apparatus according to the invention, FIGS. 3*a* and *b* show a horizontal part-section through an apparatus according to the invention, in two different working positions.

DETAILED DESCRIPTION OF THE INVENTION

In FIG. 1, the membrane film 2 may fit firmly with a collar 6 on the edge of the can 1 before connection to the can wall. However, this is only an intermediate step in the closing of the can 1 and should not hinder the subsequent steps. This involves the action of a ram, which presses the membrane film 2 into the position shown. The collar 6 slides from the position indicated by a dash-dot line, in which it is present before the ram is pressed down, into the interior of the can 1 and, owing to the ductility of the film material (in combination with sufficient toughness), rests against the inner circumference of the can 1 in the position indicated by solid lines. Furthermore, the conicity of the film edge region 5 with a small angle β is converted into a cylindrical shape, so that the film edge region 5 rests tightly against the can circumference. As a result of the small conicity, the formation of creases and wrinkles is avoided.

Figure 1A:
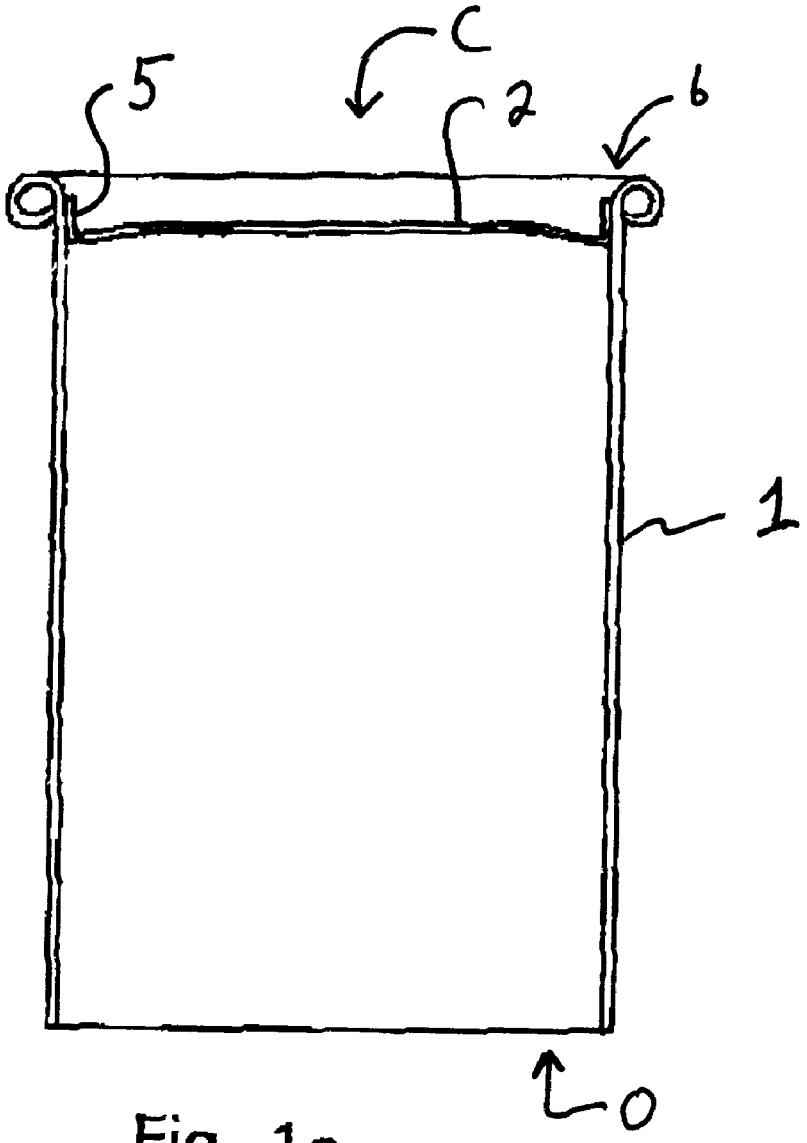
FIG. 1*a* shows an intermediate can structure in accordance with the present invention, in cross section, that is open at one end and sealed at the opposite end by a closure diaphragm in accordance with the present invention.

FIG. 1*a* illustrates an intermediate can structure in accordance with the present invention, wherein can 1 is open at one end O and closed at the opposite end C by a closure diaphragm 2 in accordance with the present invention. The intermediate can structure shown in FIG. 1*a* is fillable at the open end O prior to sealing and closing of the can.

Figure 1B:
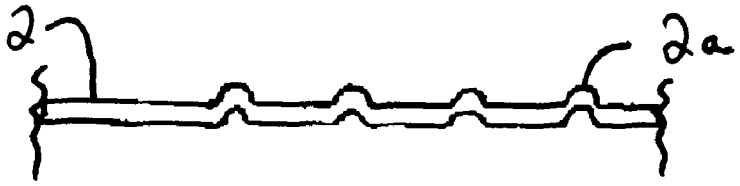
FIG. 1*b* shows a cross-section, with portions broken away, of an embossed and grained metal closure diaphragm in accordance with embodiments of the present invention.

In accordance with an embodiment shown in FIG. 1*b*, a grained metal closure diaphragm membrane film 2 in accordance with the present invention is embossed at 2*a*. In preferred embodiments, the closure diaphragm membrane foil is not more than about 0.2 mm in thickness, and preferably greater than about 0.01 mm in thickness.

As described below, the apparatus according to the invention tightly connects the membrane film 2 to the cylindrical region of the can inner wall.

According to a preferred embodiment, the ram 8 is formed similarly to the section shown in FIG. 2. It consists of a plurality of parts, namely the actual ram surface 9, which is connected by upward-projecting pegs 10 (only one is shown, there are preferably three) to the extension 11 of a ram head 12. Placed around the ram surface 9 is a centering ring 13 which is displaceable along guide pins 14 and against the action of at least one pressure spring 15. Usually, the ring 13 assumes the lowered position on the left in FIG. 2, in which, for example, it is supported in a manner not shown on the upper side of the ram surface 9, but is optionally also held by other means.

In this position, the centering ring 13 holds the can edge, and has a recess 13' for this purpose. The process can now take place in such a way that the can 1 stands on a lifting table and is raised, with the result that the centering ring 13 moves to the upper position shown on the right against the action of the spring 15. At the same time, the ram surface 9 emerges from the interior of the ring 13 and thus presses the membrane film 2 into the position shown in FIG. 1.

Alternatively, the ring 13 could also be stationary and the can could be held in a centered position while the ram surface 9 is moved downward. In this case, for example, the extension 11 would have to be formed as a piston rod of a fluidic unit, preferably of a pneumatic piston-cylinder unit. Of course, there is further latitude here for design considerations, since in fact all that is important is the relative movement of the parts shown and the can. Moreover, the centering of the can or of the membrane film 2 relative to it could take place in various manners.

It is clear from the above explanations that it is important to place the raised film edge region 5 of the membrane film 2 as closely as possible against the inner circumference of the can (as shown in FIG. 1) in order to connect it firmly to said circumference. For this purpose, the ram 8 has a spreading apparatus which is formed by a wedge arrangement in the embodiment according to FIG. 2. A number of wedge segments 16 is guided along the upper side of the ram surface 9 so that they can be moved radially outward relative to the central axis A of the ram 8. For guidance, the back of the ram surface 9 could have, for example, grooves or slots (not shown). However, the flat back of the ram surface may also be sufficient for guidance.

Although the wedge segments 16 could themselves be used for pressing the raised film edge region 5 of the membrane film 2 against the inner circumference of the can 1, it is advantageous if they are surrounded by elastic piston rings 17 or circlip rings. This creates a more uniform circumferential surface during pressing of these rings 17 against the film edge region 5 of the membrane film 2 and, in a dual function, moreover provides a restoring force which acts on the segments 16.

A conical wedge 18 is provided for pressing the wedge segments 16 radially outward, which wedge can be moved downward and between the wedge segments with their wedge surfaces 20 by means of an actuating rod 19 from a drive, preferably the pneumatic type. The reason for preferring a pneumatic drive is that there is scarcely any danger of soiling by oil or leaking liquids and a maximum pressure which does not extend the can may be particularly easily established. If the conical wedge 18 is now moved downward toward the ram surface 9, it spreads the wedge segments 16 apart and thus presses the elastic rings 17 outward against the film edge region 5 (which is indicated partially on the right in FIG. 2), where the can edge is fixed in the recess 16'. In this way, the desired position of the membrane film 2 is achieved.

In this position, however, the membrane film 2 must also be secured and in general also sealed. This can be done in a conventional manner by means of adhesion, preferably by means of heat-sealing, because the thin membrane film 2 is in fact a relatively good heat conductor. For this purpose, the outside of the film edge can be coated with a hotmelt adhesive. A heating means is then coordinated with the spreading apparatus 16–18. Said heating means could be formed per se by heater windings housed in the wedge segments 16, but space is very limited at this point, movable connections also having to be provided. Although this possibility should not be ruled out, a radiant heat source 22 (e.g. an annular one) may be provided, for example above the wedge segments 16 and the rings 17, which heat source heats these parts in order to heat up the hotmelt adhesive and to fuse it with the inner wall of the can 1. The wedge segments 16 may be formed, for example, from a ceramic material having good heat storage properties, which also improves the wear properties.

Figure 3A:
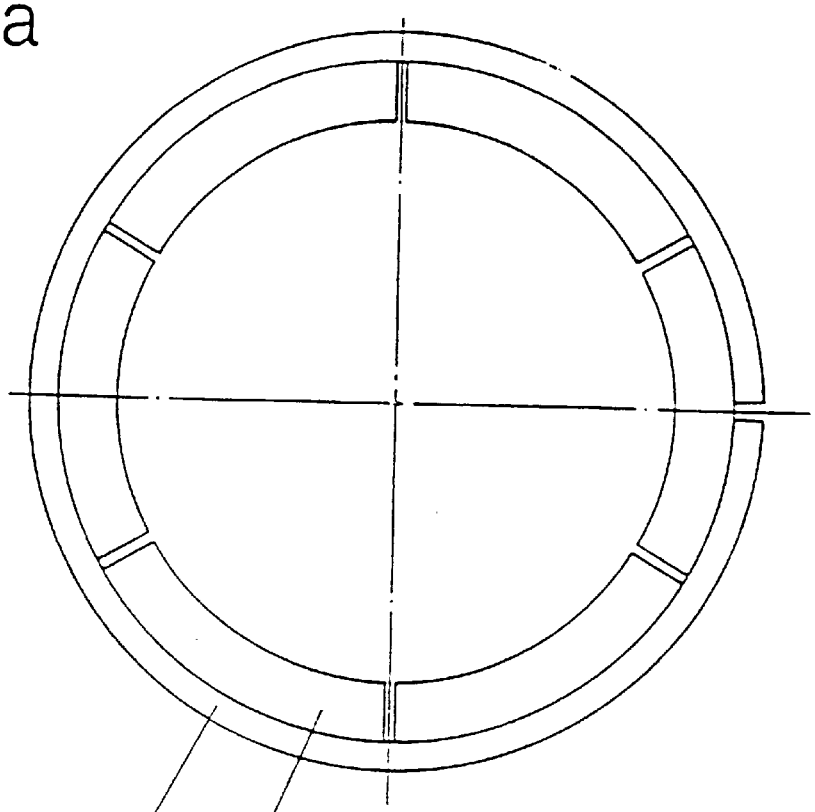
Figure 3B:
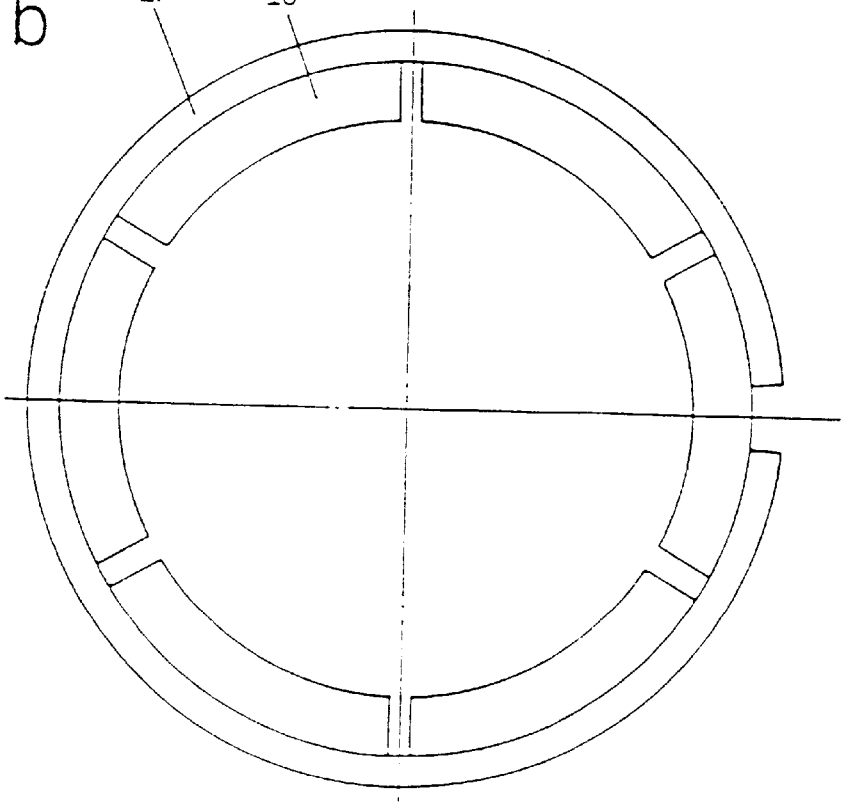

The wedge segments 16 and the spring ring 17 are shown in the closed position in FIG. 3*a* and in the spread position in FIG. 3*b* (by means of the wedge sections 18 of the ram 8 which is not shown here and which is moved perpendicularly to the plane of the drawing) for heat-sealing the membrane film 2 to the can inner wall.

Of course, the wedge arrangement shown is only one possible embodiment, which may be preferred with regard to the life of the apparatus, and many modifications are possible within the scope of the invention. For example, the conical wedge 18 could be simply formed by a pressure plate movable relative to the ram surface 9, it being possible to provide a rubber bellows between the upper side of the ram surface 9 and this pressure plate. Said bellows expands laterally from the top when supplied with a pressure medium through the pressure plate, which is used in place of the part 18 and will then also be connected to the rod 19 for its actuation, and thus presses on the displaceable parts 16 or directly on the rings 17. A horizontal drive, radially outward, would also be possible for the individual segments 16 but of complicated design. Particularly in this case, but also in other cases, heating of the upper can edge from the outside may be the simpler solution of heat-sealing.

Figure 4A:
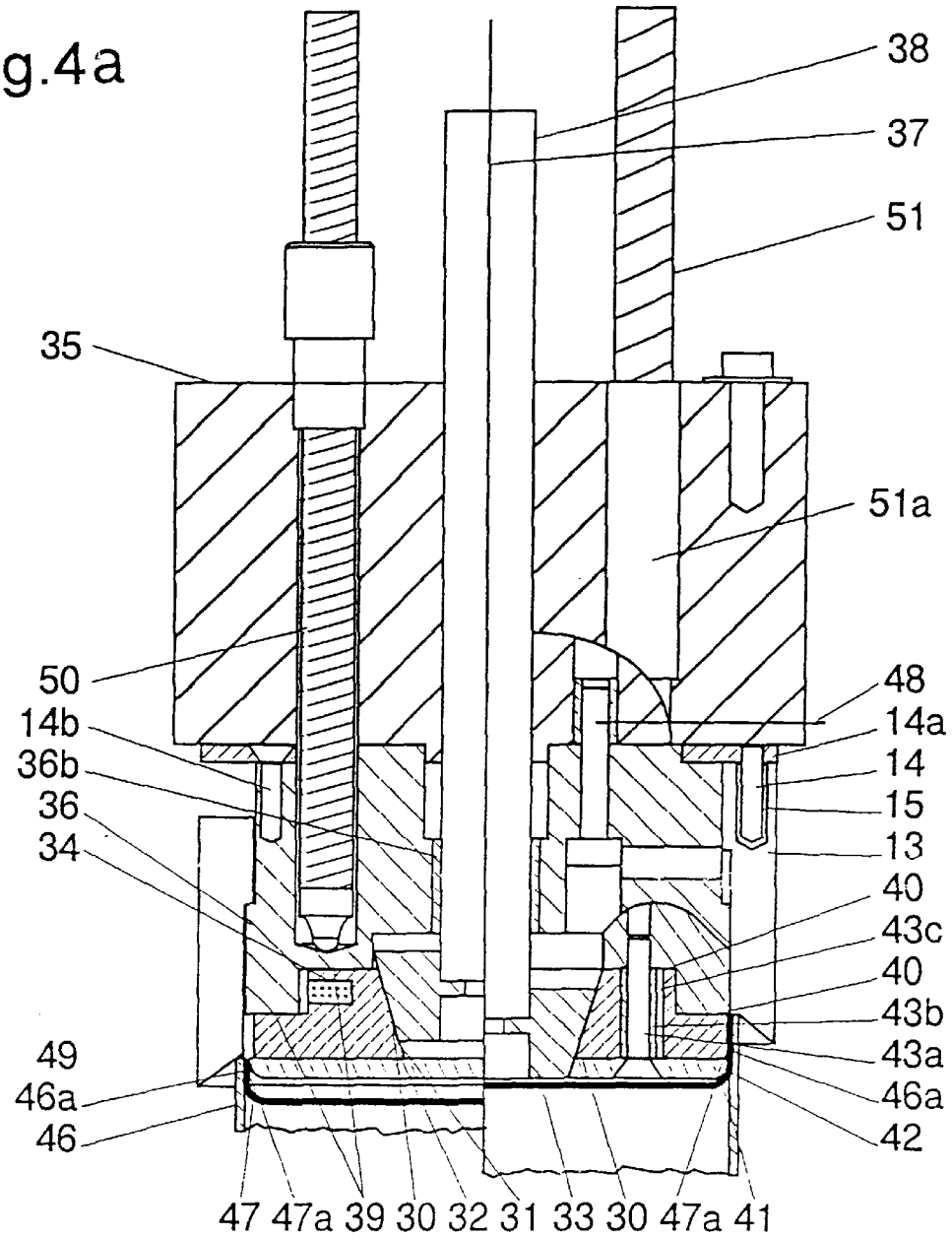
FIG. 4*a* shows a section through a press apparatus having press parts guided by a fixed ram surface, the feed position being shown on the left and the pressing position on the right.

According to FIG. 4, a press apparatus according to the invention comprises press parts 30, each of which rests with a conical abutting surface 31 against an actuating surface 32 of a conical actuating element 33. In order to ensure that the abutting surfaces 31 always rest against the actuating surface 32, a restoring means, preferably at least one restoring spring 30, is coordinated with each press element 30. The restoring springs 34 press the press elements 30 of a heat-conducting member 36 held by a fixed retaining part 35 equipped with heating cartridges 51*a* radially against the actuating element 33. The press parts 30 are movable along an axis 37 radially with respect to the axis 37 as a result of a movement of the actuating element 33. For actuation, an actuating rod 38 guided by the retaining part 35 and the heat-conducting member 36 is connected to the actuating element 33. For guidance of the actuating rod 38, in particular a sliding bearing 36*a* is provided in the heat-conducting member.

Figure 5:
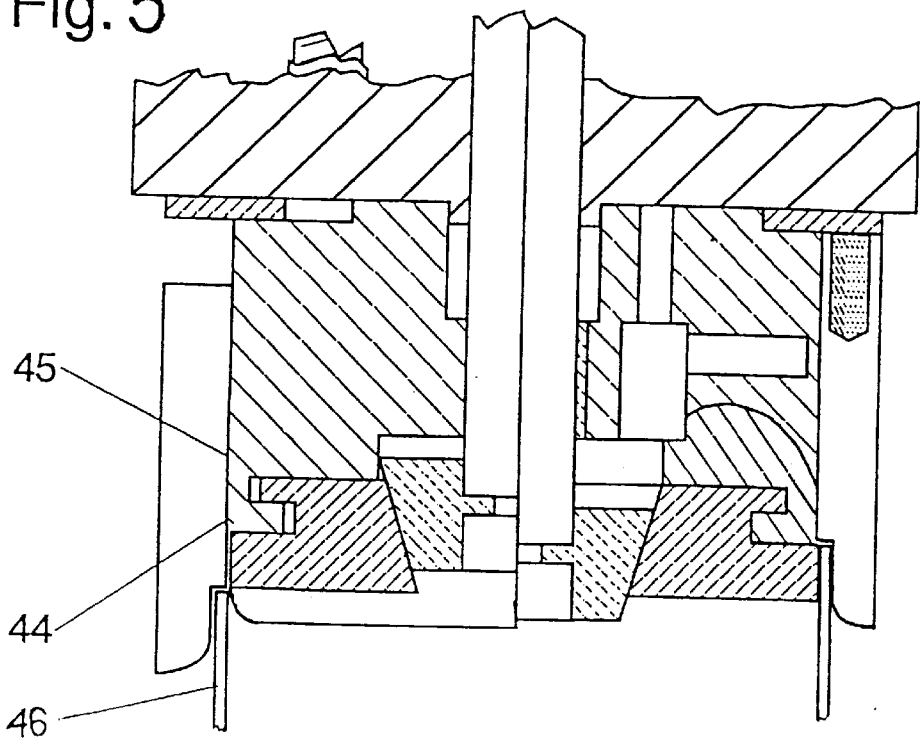
FIG. 5 shows a section through a press apparatus having press parts guided on the heat-conducting member.

In order to guide the movement of the press part, the heat-conducting member 36 has heating surfaces 39 which are arranged vertically with respect to the axis 37 and rest against transmission surfaces 40 of the press parts 30. The end surfaces 41 facing away from the transmission surfaces 40 are guided by the inside of a fixed ram surface 42. The ram surface 42 is connected to the heat-conducting member 36 via fastening parts 43*a* and spacers 43*b*, which pass through passages 43*c* in the press parts 30. Instead of guidance with the ram surface 42, guidance can be achieved, for example according to FIG. 5, by radial guide slots 44 in the heat-conducting member 36 and by extensions 45 of the press elements 30, which extensions are guided therein.

On feeding a cylindrical can 46 having a first contact surface 46*a* arranged on the inner surface of the can 46, a second cylindrical contact surface 47*a* of an inserted separation membrane 47 rests, for example, against this contact surface 46*a*. The can is optionally held by the free end of a displaceable centering ring 13, which end comprises in particular a feed region, and is fed above the press parts 30 by the displacement of the centering ring. The centering ring 13 is guided parallel to the axis on the heat-conducting member and/or on guide pins 14 and is pressed away from the retaining part 35 by at least one pressure spring 15. The bolts 14 project from a disk 14*a* which is fastened to the heat-conducting member 36 by means of screws 14*b*. The heat-conducting member 36 is fastened to the retaining part 35 by means of screws 48.

In the inserted state, the contact surfaces 46*a* and 47*a* enclose the press surface 49 formed by the press parts. Pressing of the contact surfaces 46*a*, 47*a* is effected by the movement of the press parts 30 from the feed position to the pressing position. The centering ring 13 is optionally formed so that a part-surface can be used as an abutting surface. To be able to achieve a seal directly during pressing, the heat released by the heat-conducting member 36 passes from the heating surfaces 39 via the transmission surfaces 40 to the press surface 49. The temperature of the heat-conducting member is measured by a temperature sensor 50 and used for controlling the supply of the heating cartridges 51*a*. The supply is via supply lines 51.

Figure 4B:
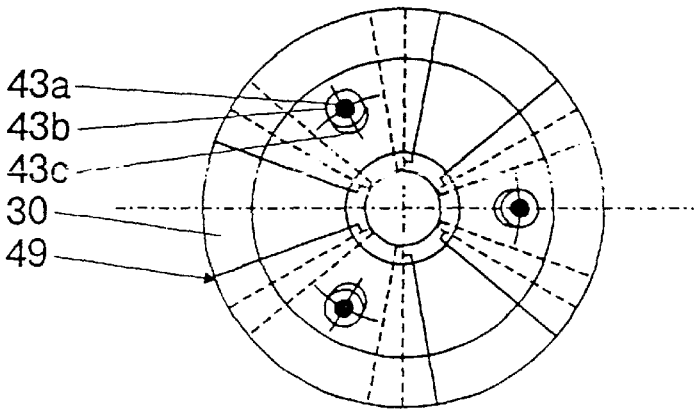
FIG. 4*b* shows a plan view of the press parts.
Figure 6:
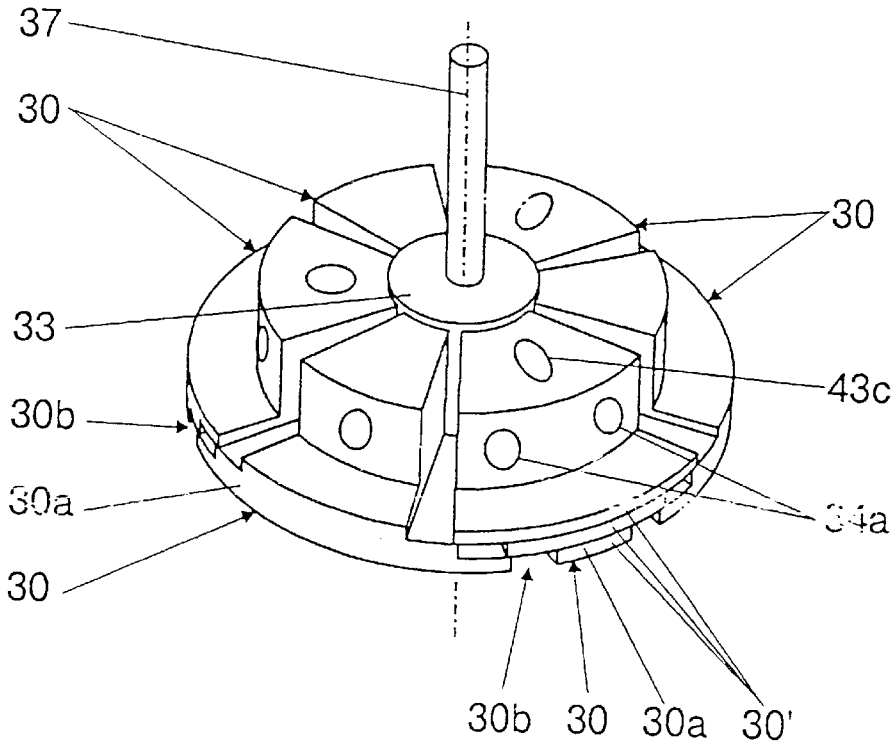
FIG. 6 shows a perspective view of the press parts.

The formation of the press parts 30 is illustrated by the plan view in FIG. 4*b* and the perspective view in FIG. 6. In the embodiment shown, six press parts 30 are assembled to give a press ring. Sets of three press parts 30 are identical. In the assembly, alternate press parts 30 are adjacent to one another. The press surfaces 30*a* of the press parts 30 have a step-like edge in the circumferential direction, one type of press parts having ascending steps 30*b* on one side and descending ones on the other side, and the other press parts conversely having ascending or descending steps 30*b*, respectively, adapted thereto. Those steps of different press parts which are adjacent to one another in the axial direction always have an overlap in the embodiment shown. As a result of the axial movement of the actuating element 33, the press parts 30 are moved radially; the overlap also varies. Since the radial movement is very small, the gaps in the circumferential direction can be chosen very small. They are exaggerated in FIG. 6. Radial holes 34*a* serve for holding the restoring springs 34.

To simplify the production of the press parts 30, they are assembled from segments of various sizes having part-surfaces 30', as indicated for a press part in FIG. 6. Instead of a fixed connection, the segments may optionally each be radially guided by a common guide means. Of course, various step shapes 30*b* adapted to one another can be provided. By using a large number of steps, the step height can be kept very small. Instead of six press parts 30, any desired number, preferably a larger number and in particular an even number, of press parts 30 may be used.

Figure 7:
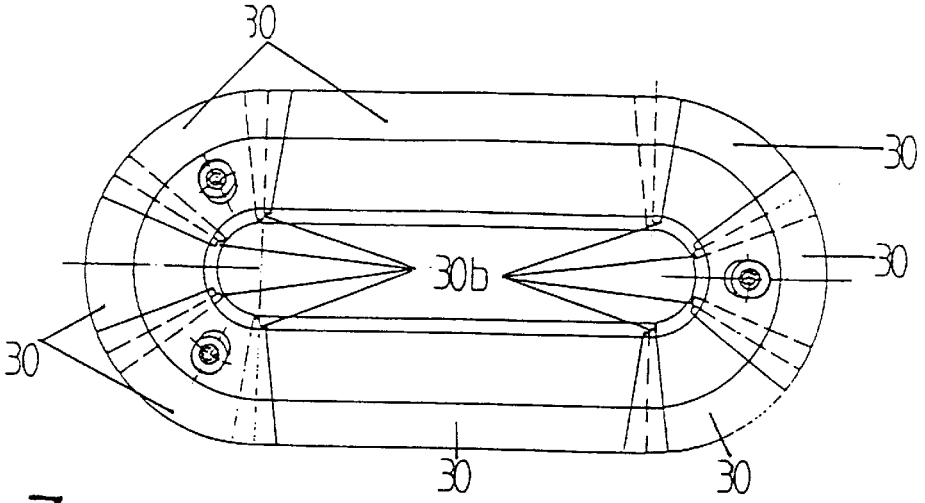
FIG. 7 shows a plan view of the press parts for an oval can.
Figure 8:
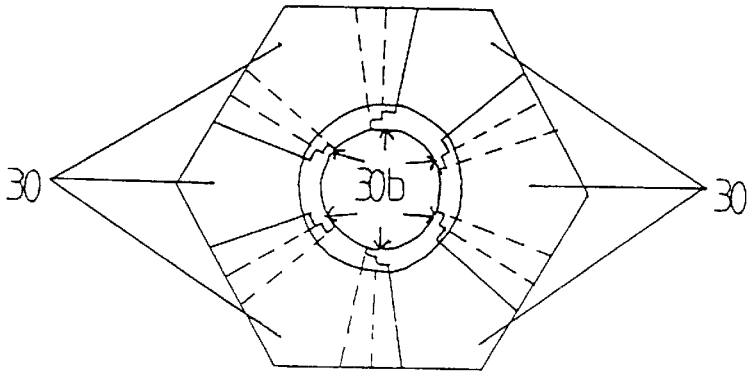
FIG. 8 shows a plan view of the press parts for a hexagonal can and FIG. 9 shows a section through a press apparatus for pressing from the outside.

FIG. 7 and FIG. 8 show, respectively, press parts 30 which are formed for pressing cans having two semicircular side regions and a straight middle region and cans having a hexagonal cross-section. The press parts 30 overlap one another with adjacent steps 30*b*. The press parts 30 are shown in a holding position in which the steps 30*b* rest tightly against one another.

Figure 9:
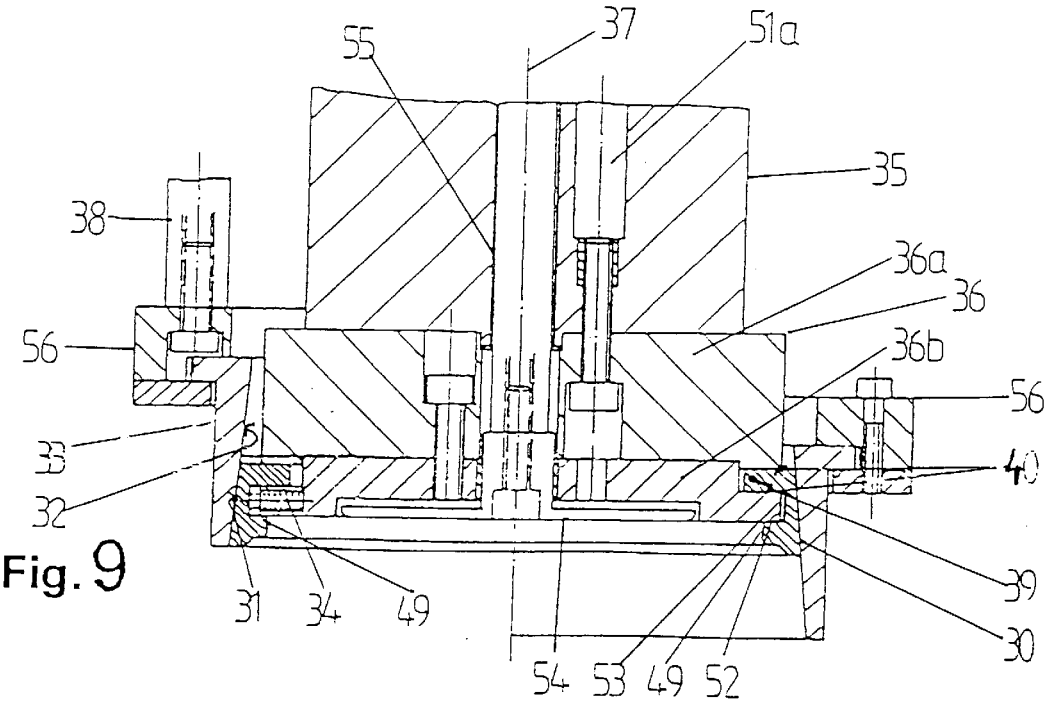

FIG. 9 shows an example of a press apparatus for pressing from the outside. A first heat-conducting part 36*a* of a heat-conducting member 36 is fastened to the retaining part 35 having the heating cartridges 51*a*, and a second heat-conducting part 36*b* is fastened to said first heat-conducting part. A radially projecting guide groove 52 which fits into guide slots 53 of press parts 30 in the form of annular segments is formed on the second heat-conducting part 36*b*. The guide slots 53 are open toward the axis 37 and, together with the guide groove 52, form a radial guide in which the press parts 30 are radially movable but axially fixed.

The press surfaces 49 of the press parts 30 are directed inward toward the axis 37. To move the press surfaces inward for pressing together contact surfaces of a can, the press parts 30 grip the outward-pointing conical abutting surfaces 31 which rest against an inward-facing, conical actuating surface 32 of an annular actuating element 33. In order to ensure that the abutting surfaces 31 always rest against the actuating surface 32, a restoring means, preferably at least one restoring spring 34, is coordinated with each press element 30. The restoring springs 34 press the press elements 30 from the second heat-conducting part 36*b* radially outward against the actuating element 33. The press parts 30 can be moved radially with respect to the axis 37 as a result of the movement of the actuating element 33 in the direction of the axis 37. For actuation, at least one actuating rod 38' is connected to the actuating element 33 via a connection means 56.

In order to ensure good heat transmission from the heat-conducting member to the press parts 30, heating surfaces 39 are formed on the first and on the second heat-conducting part 36*a* and 36*b*, transmission surfaces 40 of the press parts 30 being adjacent to said heating surfaces. An ejecting apparatus which, with an ejecting surface 54 arranged between the press parts, makes it possible to eject cans is optionally provided. The ejecting surface 54 is connected to an ejecting rod 55 and can be moved by actuating said rod in the direction of the axis 37.

The invention is not limited to the embodiments shown. It is clear to a person skilled in the art that pressing from the outside can be carried out using not only circular press surfaces but also any desired concave press surfaces, in particular press surfaces having oval and polygonal, preferably hexagonal, cross-sections.

I claim:

1. A process for the production of a can structure utilizing a press apparatus for the production of an intermediate can structure having a sheet metal sidewall that is open at one end and fillable at the open end prior to sealing and closing of the can structure, the intermediate can structure having a closed end opposite said open end, the closed end being sealed by a closure diaphragm of a material selected from the group consisting of paper, plastic film and metal foil, the intermediate can structure having an axis, the closure diaphragm having a diaphragm edge region which is raised in a direction of said axis, the diaphragm edge region being tightly connected to an inner surface of said sidewall without overlapping an edge of said sidewall at said closed end, wherein an inner surface of said sidewall has a cylindrical shape in an area of the sidewall that is tightly connected to said diaphragm edge region, and wherein the diaphragm edge region is free from a heat-conducting cover, the process comprising introducing the closure diaphragm with the raised diaphragm edge region into the can structure having the sidewall with the inner surface, pressing the diaphragm edge region by expansion against the inner surface of the sidewall with an adjustable press surface of the press apparatus, and tightly connecting the raised edge region substantially over a total vertical distance thereof, to the inner surface of the can sidewall, by radial movement of the adjustable press surface.

2. An intermediate can structure having a sheet metal sidewall that is open at one end and fillable at the open end prior to sealing and closing of the can structure, the intermediate can structure having a closed end opposite said open end, the closed end being sealed by a closure diaphragm of a material selected from the group consisting of paper, plastic film and metal foil, the intermediate can structure having an axis, the closure diaphragm having a diaphragm edge region which is raised in a direction of said axis, the diaphragm edge region being tightly connected to an inner surface of said sidewall without overlapping an edge of said sidewall at said closed end, wherein an inner surface of said sidewall has a cylindrical shape in an area of the sidewall that is tightly connected to said diaphragm edge region, and wherein the diaphragm edge region is free from a heat-conducting cover.

3. An intermediate can structure according to claim 2, wherein the closure diaphragm is not more than about 0.2 mm in thickness, and is selected from the group consisting of embossed diaphragm material and grained metal foil.

4. An intermediate can structure according to claim 2, having a configuration selected from the group consisting of 1) a can structure wherein the edge of the can sidewall is flanged in an outward direction, and 2) a can structure wherein the diaphragm edge region rests against the inner surface of the can substantially without creases or wrinkles.

5. A foil for the manufacture of a can structure according to claim 2, characterized in that the foil has, in a radial outer part thereof, a raised foil edge region which diverges conically upwards by about 0.2 to 0.3 mm.

6. The foil of claim 5 having a heat-sealed coating on an outer surface thereof.

7. A foil according to claim 5 having a foil edge region with a free end including a collar which points radially outward and is substantially hook-shaped in cross-section.

8. A press apparatus for carrying out a process for the production of an intermediate can structure having a sheet metal sidewall that is open at one end and fillable at the open end prior to sealing and closing of the can structure, the intermediate can structure having a closed end opposite said open end, the closed end being sealed by a closure diaphragm of a material selected from the group consisting of paper, plastic film and metal foil the intermediate can structure having an axis, the closure diaphragm having a diaphragm edge region which is raised in a direction of said axis, the diaphragm edge region being tightly connected to an inner surface of said sidewall without overlapping an edge of said sidewall at said closed end, wherein an inner surface of said sidewall has a cylindrical shape in an area of the sidewall that is tightly connected to said diaphragm edge region, and wherein the diaphragm edge region is free from a heat-conducting cover, said process comprising introducing the closure diaphragm with the raised diaphragm edge region into the can structure having the sidewall with the inner surface, pressing the diaphragm edge region by expansion against the inner surface of the sidewall with a punch having an expandable circumference, and tightly connecting the raised edge region substantially over a total vertical distance thereof, to the inner surface of the can sidewall, under action of heat, wherein the expansion is effected without an external pressure absorption apparatus, the press apparatus for tightly connecting the can sidewall to the closure diaphragm, the press apparatus having at least two press parts which together form an adjustable press surface arranged around an axis and comprising part-surfaces, wherein the press parts are arranged substantially fixed in an axial direction and can be moved radially by an actuating element displaceable in the axial direction.

9. The apparatus as claimed in claim 8, wherein the part-surfaces are arranged in a plurality of layers in the axial direction, with the part-surfaces of adjacent layers being formed to overlap in a circumferential direction.

10. The apparatus as claimed in claim 8, wherein adjacent part-surfaces are in different layers which are formed by parts adjacent to one another in the axial direction.

11. The apparatus as claimed in claim 8, wherein the press parts are in a form of segments and are mounted so that they are substantially radially movable with each segment having a central region in a linear guide substantially normal to the axis, wherein the part-surfaces are arranged in adjacent layers having a degree of overlap which varies during radial movement between a feed position and a pressing position, wherein adjacent layers of part-surfaces have steps fitting into one another, or layers of the press parts engage one another.

12. The apparatus as claimed in claim 8, wherein the press surface is provided for pressing in a configuration selected from the group consisting of convex for pressing from inside the can wall, and concave for pressing from outside the can wall.

13. The apparatus of claim 12 wherein the press surface has a circular crosssection and the press surface has a radius which is about equal to a radius of a contact surface to be pressed.

14. The apparatus as claimed in claim 8, wherein the press parts comprise flat part-surfaces.

15. The apparatus as claimed in claim 8, wherein the press surface has a shape selected from the group consisting of at least a partly cylindrical shape and at least a partly conical shape.

16. The apparatus as claimed in claim 15, adapted to a flanged can end.

17. The apparatus as claimed in claim 8, wherein at least one heating element is provided in heat-conducting contact with a heat transmission surface connected to a press part.

18. The apparatus as claimed in claim 17, wherein said at least one heating element is normal to said axis.

19. The apparatus of claim 17 wherein said at least one heating element includes at least one heating surface of a heat-conducting member which is adjacent to said transmission surface, wherein said heating surface is a guide surface for movement of the press parts.

20. The apparatus as claimed in claim 8, wherein the actuating element has a conical actuating surface which is arranged around the axis and against which conical abutting surfaces of the press parts rest, the press parts being radially guided and being capable of being pressed against the actuating surface by restoring elements, in order to achieve radial movement of the press parts.

21. The apparatus as claimed in claim 8, wherein the part-surfaces each extend along a part of a circumferential line in a plane which is substantially perpendicular to the axis, and wherein there are gaps between part-surfaces of a first circumferential line which are staggered relative to gaps of another circumferential line in the circumferential direction, so that the press surface has no continuous gaps.

22. An apparatus according to claim 8, including an expansion device comprising a plurality of radially expanding rings having mutually staggered openings, said rings being connected to a plurality of annularly arranged wedges.

23. An apparatus according to claim 8, comprising an expansion device including an elastic ring arranged along a circumference of the press parts.

24. A process for the production of an intermediate can structure having a sheet metal sidewall that is open at one end and fillable at the open end prior to sealing and closing of the can structure, the intermediate can structure having a closed end opposite said open end, the closed end being sealed by a closure diaphragm of a material selected from the group consisting of paper, plastic film and metal foil, the intermediate can structure having an axis, the closure diaphragm having a diaphragm edge region which is raised in a direction of said axis, the diaphragm edge region being tightly connected to an inner surface of said sidewall without overlapping an edge of said sidewall at said closed end, wherein an inner surface of said sidewall has a cylindrical shape in an area of the sidewall that is tightly connected to said diaphragm edge region, and wherein the diaphragm edge region is free from a heat-conducting cover, said process comprising introducing the closure diaphragm with the raised diaphragm edge region into the can structure having the sidewall with the inner surface, pressing the diaphragm edge region by expansion against the inner surface of the sidewall with a punch having an expandable circumference, and tightly connecting the raised edge region substantially over a total vertical distance thereof, to the inner surface of the can sidewall, under action of heat, wherein the expansion is effected without an external pressure absorption apparatus.

25. A process according to claim 24, characterized in that the expansion of the punch circumference is effected by a combination of wedges, and piston rings or spring rings.

26. A process according to claim 24, characterized in that the expansion of the punch circumference is effected by a pneumatically operated rubber bellows.

27. A can of sheet metal having a closure diaphragm of paper, plastic film or metal foil which is provided on at least one end face of the can and closes the at least one end face so that an outer surface of a diaphragm edge region which is raised in a direction of a can axis is tightly connected to an inner surface of the can wall, without overlapping an edge of the can wall, obtained by a process according to claim 24.

28. An apparatus for carrying out a process for the production of an intermediate can structure having a sheet metal sidewall that is open at one end and fillable at the open end prior to sealing and closing of the can structure, the intermediate can structure having a closed end opposite said open end, the closed end being sealed by a closures diaphragm of a material selected from the group consisting of paper, plastic film and metal foil, the intermediate can structure having an axis, the closure diaphragm having a diaphragm edge region which is raised in a direction of said axis, the diaphragm edge region being tightly connected to an inner surface of said sidewall without overlapping an edge of said sidewall at said closed end, wherein an inner surface of said sidewall has a cylindrical shape in an area of the sidewall that is tightly connected to said diaphragm edge region, and wherein the diaphragm edge region is free from a heat-conducting cover, said process comprising introducing the closure diaphragm with the raised diaphragm edge region into the can structure having the sidewall with the inner surface, pressing the diaphragm edge region by expansion against the inner surface of the sidewall with a punch having an expandable circumference, and tightly connecting the raised edge region substantially over a total vertical distance thereof, to the inner surface of the can sidewall, under action of heat, wherein the expansion is effected without an external pressure absorption apparatus, the apparatus having a displaceably mounted punch with a circumference expandable transversely to a displacement direction, a displacement device for the punch and an expansion device for producing corresponding movements, further including at least one feature selected from the group consisting of 1) a centering device for centering at least one member selected from the group consisting of the diaphragm foil, the can or a combination thereof, 2) a heating device for heating a circumference of the punch, and 3) a combination thereof.

* * * * *